US009513593B2

(12) United States Patent
Ichijo

(10) Patent No.: US 9,513,593 B2
(45) Date of Patent: Dec. 6, 2016

(54) IMAGE FORMING APPARATUS AND PROCESS CARTRIDGE

(71) Applicant: FUJI XEROX CO., LTD., Tokyo (JP)

(72) Inventor: Nagahito Ichijo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/183,819

(22) Filed: Feb. 19, 2014

(65) Prior Publication Data

US 2015/0010339 A1 Jan. 8, 2015

(30) Foreign Application Priority Data

Jul. 2, 2013 (JP) ..... 2013-139268

(51) Int. Cl.

| | |
|---|---|
| ***G03G 9/08*** | (2006.01) |
| ***G03G 21/00*** | (2006.01) |
| ***G03G 21/18*** | (2006.01) |
| ***G03G 9/097*** | (2006.01) |

(52) U.S. Cl.

CPC ..... *G03G 21/0017* (2013.01); *G03G 9/0827* (2013.01); *G03G 9/09716* (2013.01); *G03G 9/09725* (2013.01); *G03G 21/0011* (2013.01); *G03G 21/18* (2013.01)

(58) Field of Classification Search

CPC .. G03G 9/0827; G03G 9/0833; G03G 9/0834; G03G 21/0011

USPC ..... 399/252, 350

See application file for complete search history.

(56) References Cited

U.S. PATENT DOCUMENTS

2004/0058258 A1* 3/2004 Yoshino et al. ..... 430/108.1
2007/0020005 A1* 1/2007 Shigezaki et al. ..... 399/349

FOREIGN PATENT DOCUMENTS

| | | | |
|---|---|---|---|
| JP | A-2003-140468 | | 5/2003 |
| JP | 2004-045668 | A | 2/2004 |
| JP | 2004-287075 | A | 10/2004 |
| JP | 2006-178005 | A | 7/2006 |
| JP | 2007-003694 | A | 1/2007 |
| JP | 2010139819 | A * | 6/2010 |

OTHER PUBLICATIONS

May 24, 2016 Office Action issued in Japanese Patent Application No. 2013-139268.
Translation of Sep. 6, 2016 Office Action issued in Japanese Patent Application No. 2013-139268.

* cited by examiner

*Primary Examiner* — Erika J Villaluna
(74) *Attorney, Agent, or Firm* — Oliff PLC

(57) ABSTRACT

An image forming apparatus includes an image holding member; a charging unit; an electrostatic charge image forming unit; a developing unit that accommodates an electrostatic charge image developer that contains toner particles having a shape factor SF1 of 120 to 145 and hydrophobic inorganic oxide particles having a number average particle diameter of 30 nm to 80 nm and satisfies the Formula (1), and develops the electrostatic charge image formed on the surface of the image holding member to form a toner image, by the electrostatic charge image developer; a transfer unit; and a cleaning unit that includes a cleaning blade which contacts with the surface of the image holding member at contact pressure of 9.8 mN/mm to 21.6 mN/mm, and removes toner remaining on the surface of the image holding member after transferring the toner image by the cleaning blade:

$$Q \geq 160 - 12R \quad (1).$$

8 Claims, 3 Drawing Sheets

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2013-139268 filed Jul. 2, 2013.

BACKGROUND

1. Technical Field

The present invention relates to an image forming apparatus and a process cartridge.

2. Related Art

As an electrophotographic image forming apparatus, there is known an apparatus having a cleaning unit which causes a cleaning blade to contact with a surface of a photoreceptor to clean residual toner.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that accommodates an electrostatic charge image developer including toner that contains toner particles having a shape factor SF1 of 120 to 145 and hydrophobic inorganic oxide particles having a number average particle diameter of 30 nm to 80 nm and satisfies the following Formula (1), and develops the electrostatic charge image which is formed on the surface of the image holding member to form a toner image, by the electrostatic charge image developer;

a transfer unit that transfers the toner image which is formed on the surface of the image holding member to a surface of a recording medium; and a cleaning unit that has a cleaning blade which contacts with the surface of the image holding member at contact pressure of 9.8 mN/mm to 21.6 mN/mm, and removes toner remaining on the surface of the image holding member after transferring the toner image by the cleaning blade:

$$Q \geq 160-12R \quad (1)$$

wherein Q represents the shape factor SF1 of the toner particles and R represents content (% by weight) of the hydrophobic inorganic oxide particles in the toner.

BRIEF DESCRIPTION OF THE DRAWINGS

Exemplary embodiments of the present invention will be described in detail based on the following figures, wherein.

DETAILED DESCRIPTION

Figure 1:
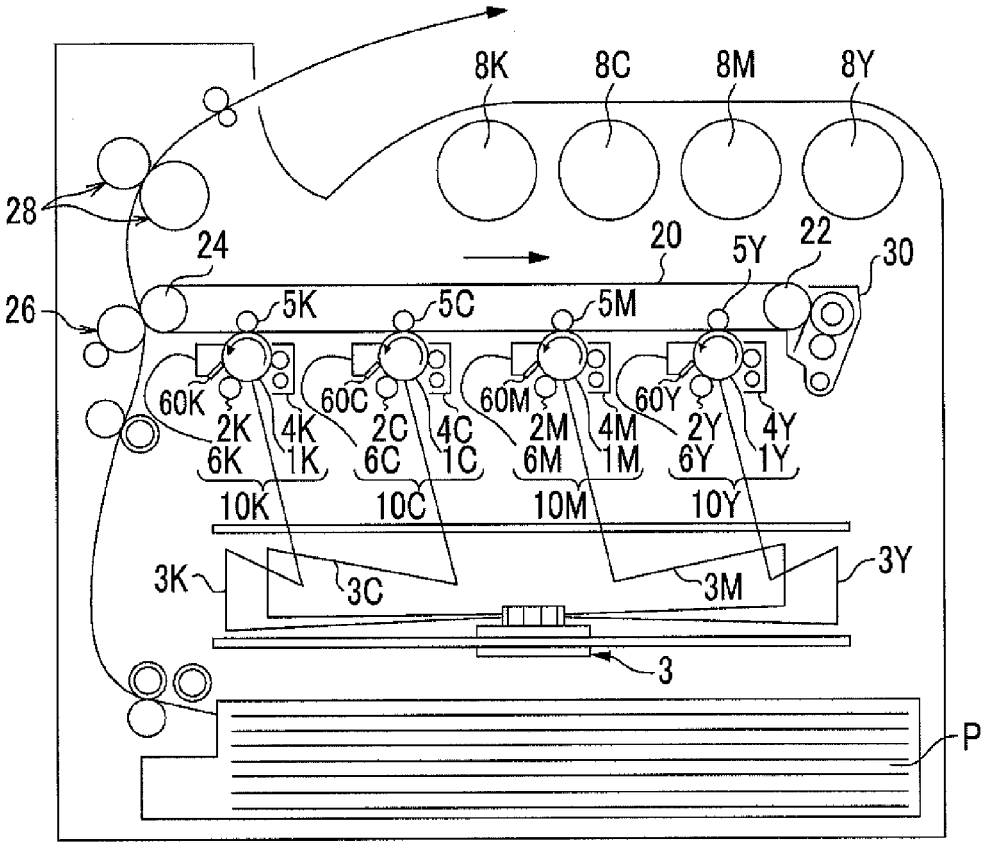
FIG. 1 is a schematic configuration diagram showing an example of an image forming apparatus according to the exemplary embodiment.

Hereinafter, exemplary embodiments of the invention will be described. The descriptions and examples are for describing the exemplary embodiments of the invention, and do not limit the scope of the exemplary embodiments of the invention.

In the present specification, (meth)acryl means acryl and methacryl, (meth)acrylate means acrylate and methacrylate, and (meth)acrylo means acrylo and methacrylo.

Image Forming Apparatus and Process Cartridge

An image forming apparatus according to the exemplary embodiment includes an image holding member, a charging unit that charges a surface of the image holding member, an electrostatic charge image forming unit that forms an electrostatic charge image on a charged surface of the image holding member, a developing unit which accommodates an electrostatic charge image developer and develops an electrostatic charge image which is formed on the surface of the image holding member by the electrostatic charge image developer to form a toner image, a transfer unit which transfers the toner image formed on the surface of the image holding member to a surface of a recording medium, and a cleaning unit which cleans toner remaining on the surface of the image holding member after transferring the toner image.

Herein, the cleaning unit has a cleaning blade which contacts with the surface of the image holding member at contact pressure of 9.8 mN/mm to 21.6 mN/mm, and cleans the toner remaining on the surface of the image holding member after transferring the toner image.

The electrostatic charge image developer contains toner, and the toner contains toner particles having a shape factor SF1 of 120 to 145 and hydrophobic inorganic oxide particles having a number average particle diameter of 30 nm to 80 nm, and satisfies the following Formula (1).

$$Q \geq 160-12R \quad (1)$$

In Formula (1), Q represents the shape factor SF1 of the toner particles and R represents content (% by weight) of the hydrophobic inorganic oxide particles in the toner.

The image forming apparatus according to the exemplary embodiment has the configuration described above, and accordingly has an excellent cleaning property of the image holding member and a long lifetime of the image holding member. The reasons thereof are considered as follows.

In the electrophotographic image forming apparatus, in order to improve quality of an image and a transfer effect of toner, toner having a nearly true spherical shape (for example, a shape factor of toner particles of 120 to 145) is used.

However, when cleaning the residual toner on the surface of the image holding member (for example, photoreceptor) with a cleaning blade, slipping of the toner from the cleaning blade occurs as the shape of the toner is close to a true sphere, and accordingly, filming phenomenon in which toner particles or external additive particles contained in toner are pressed and coats the surface of the image holding member as a film) may occur. As a result, it is difficult to use the image holding member over a long time.

Meanwhile, if the contact pressure of the cleaning blade is increased to suppress the slipping of the residual toner, abrasion of the image holding member is accelerated, and the lifetime of the image holding member is shortened.

In the exemplary embodiment, the toner particle having the shape factor SF1 of 120 to 145 and the hydrophobic inorganic oxide particles having a number average particle diameter of 30 nm to 80 nm as an external additive are mixed with each other, and an amount of the hydrophobic inorganic oxide particles is set so as to satisfy Formula (1) according to the shape factor of the toner particles. Formula (1) shows a relationship in which R (external additive amount of hydrophobic inorganic oxide particles) becomes larger as Q approaches 100 (that is, as the shape of toner particles is close to a true sphere).

It is considered that the hydrophobic inorganic oxide particles are aggregated on a front part of a region (blade nip) in which the cleaning blade contacts with the photoreceptor, to form an aggregate layer, and this aggregate layer suppresses slipping of the toner from the cleaning blade. Since an amount of the hydrophobic inorganic oxide particles is added according to the shape of the toner particles, the aggregate layer is efficiently formed based on the shape of the toner particles. Therefore, although the contact pressure of the cleaning blade is set in a range (from 9.8 mN/mm to 21.6 mN/mm) lower than that of the related art, the slipping of the residual toner from the cleaning blade hardly occurs. Since the slipping of the residual toner from the cleaning blade hardly occurs, the filming hardly occurs, and the contact pressure of the cleaning blade is low, and therefore the abrasion of the image holding member is also suppressed.

In the exemplary embodiment, the contact pressure of the cleaning blade is from 9.8 mN/mm to 21.6 mN/mm (that is, 1.0 gf/mm to 2.2 gf/mm).

If the contact pressure of the cleaning blade is less than 9.8 mN/mm, the slipping of the toner occurs due to insufficient contact pressure, the filming easily occurs, and it is difficult to use the image holding member over a long time. The lower limit of the contact pressure of the cleaning blade is preferably equal to or greater than 10.8 mN/mm and more preferably equal to or more than 11.8 mN/mm.

In contrast, if the contact pressure of the cleaning blade exceeds 21.6 mN/mm, the abrasion of the image holding member is accelerated, the hydrophobic inorganic oxide particles which are aggregated on the front portion of the blade nip are more tightly aggregated and push the cleaning blade, and accordingly slip from the cleaning blade, and the filming may occur. The upper limit of the contact pressure of the cleaning blade is preferably equal to or less than 19.6 mN/mm and more preferably equal to or less than 17.6 mN/mm.

In the exemplary embodiment, the shape factor SF1 of the toner particles is from 120 to 145 and obtains excellent image quality and excellent transfer efficiency of the toner.

In the exemplary embodiment, the shape factor SF1 of the toner particles is preferably in a range of 125 to 140. If the shape factor SF1 is in the range described above, the filming of the hydrophobic inorganic oxide particles on the surface of the image holding member hardly occurs.

The shape factor SF1 of the toner particles is calculated with the following Formula (2).

$$SF1=(ML^2/A)\times(\pi/4)\times 100 \quad (2)$$

In Formula (2), ML represents an absolute maximum length of the toner particles, and A represents a projected area of the toner particles. In detail, the shape factor SF1 is digitized by analyzing a scanning electron microscopic (SEM) image using an image analyzer, and is calculated as follows. That is, a microscopic image of particles scattered on a surface of a glass slide is put in LUZEX, an image analyzer, by a video camera, maximum length and projection area are acquired for each of 100 particles, each SF1 is calculated with Formula (2), and an average value of 100 particles is calculated, and thus the shape factor is obtained.

For example, when preparing the toner particles by an aggregation coalescence method, the shape factor SF1 of the toner particles may be controlled by adjusting a temperature and retention time in a coalescence step.

In the exemplary embodiment, the number average particle diameter of the hydrophobic inorganic oxide particles is from 30 nm to 80 nm. If the number average particle diameter of the hydrophobic inorganic oxide particles is in the range described above, the hydrophobic inorganic oxide particles detached from the toner are easily aggregated on the front portion of the blade nip to form an aggregate layer.

100 hydrophobic inorganic oxide particles (primary particles) existing on the surface of the toner particles are observed by the scanning electron microscope (SEM), a maximum diameter and a minimum diameter for each particle are measured by image analysis, an intermediate value of two diameters is set to a sphere-equivalent diameter, and the number average particle diameter of the hydrophobic inorganic oxide particles is obtained by setting a number average of the sphere-equivalent diameters to a number average particle diameter.

In the exemplary embodiment, from a viewpoint of the excellent cleaning property of the image holding member and the long lifetime of the image holding member, the content of the hydrophobic inorganic oxide particles in the toner is preferably from 0.5% by weight to 5% by weight, more preferably 1% by weight to 4% by weight, and even more preferably from 1.2% by weight to 3.5% by weight.

Hereinafter, a configuration example of the image forming apparatus and the process cartridge according to the exemplary embodiment will be described.

As the image forming apparatus according to the exemplary embodiment, an image forming apparatus such as an apparatus including a fixing unit which fixes a toner image transferred to a surface of a recording medium; a direct transfer type apparatus which directly transfers a toner image formed on a surface of an image holding member to a recording medium; an intermediate transfer apparatus which performs primary transfer of a toner image formed on a surface of an image holding member to a surface of an intermediate transfer member, and performs secondary transfer of the toner image transferred to the surface of the intermediate transfer member, to a surface of a recording medium; or an apparatus which includes an erasing unit which irradiates a surface of an image holding member with erasing light before electrostatic charge to perform erasing, after transfer of a toner image is applied.

In a case of the intermediate transfer apparatus, a configuration in that the transfer unit includes for example, an intermediate transfer member to a surface of which a toner image is transferred, a primary transfer unit which performs primary transfer of the toner image which is formed on a surface of an image holding member to the surface of the intermediate transfer member, and a secondary transfer unit which performs secondary transfer of the toner image which is transferred to the surface of the intermediate transfer member to a surface of a recording medium, is applied.

In the image forming apparatus according to the exemplary embodiment, at least a portion including the image holding member, the developing unit, and the cleaning unit may be a cartridge structure (process cartridge according to the exemplary embodiment) which is detachable from the image forming apparatus. The cartridge structure may further include at least one selected from the charging unit, the exposing unit, and the transfer unit.

In the image forming apparatus according to the exemplary embodiment, an image forming method including: charging a surface of the image holding member; forming an electrostatic charge image on a charged surface of the image holding member; developing the electrostatic charge image which is formed on the surface of the image holding member to form a toner image, by the electrostatic charge image developer containing toner that contains toner particles having a shape factor SF1 of 120 to 145 and hydrophobic inorganic oxide particles having a number average particle diameter of 30 nm to 80 nm and satisfies the following Formula (1); transferring the toner image which is formed on the surface of the image holding member to a surface of a recording medium; and cleaning toner remaining on the surface of the image holding member using a cleaning blade at contact pressure of 9.8 mN/mm to 21.6 mN/mm after transferring the toner image, is performed.

$$Q \geq 160-12R \quad (1)$$

In Formula (1), Q represents the shape factor SF1 of the toner particles and R represents content (% by weight) of the hydrophobic inorganic oxide particles in the toner.

Hereinafter, an example of the image forming apparatus according to the exemplary embodiment will be described with reference to the drawings.

FIG. 1 is a schematic configuration diagram showing the image forming apparatus according to the exemplary embodiment.

The image forming apparatus shown in FIG. 1 includes first to fourth electrophotographic image forming units 10Y, 10M, 10C, and 10K (image forming units) that output images of each color such as yellow (Y), magenta (M), cyan (C), and black (K) based on image data which is subject to color separation. The image forming units (hereinafter, simply referred to "units" in some case) 10Y, 10M, 10C, and 10K are provided in a line to be separated from each other at predetermined intervals in a horizontal direction. The units 10Y, 10M, 10C, and 10K may be a process cartridge which is detachable from the image forming apparatus.

An intermediate transfer belt (one example of the intermediate transfer member) 20 is provided to be extended through each unit, on the upper portion of units 10Y, 10M, 10C, and 10K. The intermediate transfer belt 20 is provided to be wound around a driving roller 22 and a support roller 24 which contacts with an inner surface of the intermediate transfer belt 20, and is configured to travel in a direction from the first unit 10Y to the fourth unit 10K. A force is applied to the support roller 24 in a direction separating from the driving roller 22 by a spring or the like (not shown), and tension is applied to the intermediate transfer belt 20 which is wound around both rollers. An intermediate transfer member cleaning device 30 is provided to oppose the driving roller 22, on an image holding surface side of the intermediate transfer belt 20.

Each toner of yellow, magenta, cyan, and black accommodated in toner cartridges BY, 8M, 8C, and 8K is supplied to each developing device (one example of the developing unit) 4Y, 4M, 40, and 4K of units 10Y, 10M, 10C, and 10K, respectively.

Since the first to fourth units 10Y, 10M, 10C, and 10K have the same configuration, operation, and effect, the first unit 10Y which is disposed upstream of the intermediate transfer belt in a travelling direction and forms a yellow image will be described as a representative unit.

The first unit 10Y includes a photoreceptor 1Y which operates as the image holding member. A charging roller (one example of the charging unit) 2Y which charges a surface of the photoreceptor 1Y to a predetermined potential, an exposing device (one example of the electrostatic charge image forming unit) 3 which exposes the charged surface by a laser beam 3Y based on an image signal subjected to color separation, to form an electrostatic charge image, a developing device (one example of the developing unit) 4Y which supplies charged toner to the electrostatic charge image to develop the electrostatic charge image, a primary transfer roller (one example of the primary transfer unit) 5Y which transfers the developed toner image onto the intermediate transfer belt 20, and a photoreceptor cleaning device (one example of the cleaning unit) 6Y which removes toner remaining on the surface of the photoreceptor 1Y after the primary transfer are placed around the photoreceptor 1Y in this order.

The primary transfer roller 5Y is placed inside of the intermediate transfer belt 20 and is provided in a position opposing the photoreceptor 1Y. A bias power supply (not shown) which applies primary transfer bias is connected to each of the primary transfer rollers 5Y, 5M, 5C, and 5K of the respective units. A control unit (not shown) controls the transfer bias value to be applied to each primary transfer roller.

Hereinafter, an operation of forming a yellow image in the first unit 10Y will be described.

First, the surface of the photoreceptor 1Y is charged to a potential of −600 V to −800 V by the charging roller 2Y, before the operation.

The photoreceptor 1Y is formed by laminating a photosensitive layer on a conductive (for example, $1\times10^{-6}$ Ωcm or less of volume resistivity at 20° C.) substrate. The photosensitive layer normally has high resistivity (resistivity of a general polymer), but has a property that specific resistance of a portion to which the laser beam is emitted changes if the laser beam 3Y is emitted. Herein, the laser beam 3Y is emitted to the charged surface of the photoreceptor 1Y from the exposing device 3, according to yellow image data which is transmitted from the control unit (not shown). Accordingly, an electrostatic charge image having a yellow image pattern is formed on the surface of the photoreceptor 1Y.

The electrostatic charge image is an image which is formed on the charged surface of the photoreceptor 1Y, and is a so-called negative latent image which is formed as the specific resistance of the irradiated portion of the photosensitive layer with the laser beam 3Y decreases, an electrical charge on the surface of the photoreceptor 1Y flows, and meanwhile the charge on the portion to which the laser beam 3Y is not emitted remains.

The electrostatic charge image which is formed on the photoreceptor 1Y rotates to a development position which is predetermined according to the travelling of the photoreceptor 1Y. The electrostatic charge image on the photoreceptor 1Y is developed as a toner image by the developing device 4Y in this development position and is visualized.

An electrostatic charge image developer containing a yellow toner and a carrier is accommodated in the developing device 4Y, for example. The yellow toner is friction-charged by agitation in the developing device 4Y, and has a charge with the same polarity (negative polarity) as the charge which is charged on the photoreceptor 1Y and is held on a developer roller. As the surface of the photoreceptor 1Y passes through the developing device 4Y, the yellow toner is electrostatically attached to an erased latent image portion on the surface of the photoreceptor 1Y, and a latent image is developed by the yellow toner. Then, the photoreceptor 1Y on which the yellow toner image is formed travels continuously at a predetermined speed, and the toner image which is developed on the photoreceptor 1Y is carried to a predetermined primary transfer position.

When the yellow toner image on the photoreceptor 1Y is carried to the primary transfer position, the primary transfer bias is applied to the primary transfer roller 5Y, an electrostatic force directed from the photoreceptor 1Y towards the primary transfer roller 5Y is applied to the toner image, and the toner image on the photoreceptor 1Y is transferred onto the intermediate transfer belt 20. The image-transferring bias applied at that time has an opposite polarity (+) to the polarity (−) of the toner, and is controlled to, for example, +10 μA by the control unit (not shown) in the first unit 10Y.

The photoreceptor 1Y after the transferring of the toner image to the intermediate transfer belt 20 continues the rotation, and the photoreceptor 1Y contacts with a cleaning blade 60Y had in the photoreceptor cleaning device 6Y, and accordingly residual toner after the transfer of the toner image from the photoreceptor 1Y is scraped and removed. The toner removed from the photoreceptor 1Y is collected.

The photoreceptor cleaning device and the cleaning blade will be described in detail later.

The primary transfer bias to be applied to the primary transfer rollers 5M, 50, and 5K of the second unit 10M and subsequent units is controlled based on the first unit.

Accordingly, the intermediate transfer belt 20 to which the yellow toner image is transferred in the first unit 10Y is carried through the second to fourth units 10M, 10C, and 10K in this order, and each color toner image is transferred in a superimposed manner.

The intermediate transfer belt 20 to which the toner images with four colors are transferred in a superimposed manner through the first to fourth units, approaches a secondary transfer portion which is configured with the intermediate transfer belt 20, the support roller 24 which contacts with the inner surface of the intermediate transfer belt, and the secondary transfer roller (one example of the secondary transfer unit) 26 which is placed on the image holding surface side of the intermediate transfer belt 20. In contrast, recording paper (one example of the recording medium) is fed to a gap in which the secondary transfer roller 26 contacts with the intermediate transfer belt 20, through a supplying mechanism at predetermined timing, and the secondary transfer bias is applied to the support roller 24. The transfer bias applied at that time has the same polarity (−) as the polarity (−) of the toner, an electrostatic force from the intermediate transfer belt 20 towards the recording paper P is operated to the toner image, and the toner image on the intermediate transfer belt 20 is transferred onto the recording paper P. The secondary transfer bias at that time is determined based on resistivity detected by a resistivity detecting unit (not shown) which detects the resistivity of the secondary transfer portion, and is voltage-controlled.

After that, the recording paper P is sent to a nipping portion of a pair of fixing rollers of a fixing device (one example of the fixing unit) 28, the toner image is fixed onto the recording paper P, and a fixed image is formed.

As the recording paper P for transferring the toner image, plain paper which is used in an electrophotographic copying machine or printer is used, for example. As the recording medium, an OHP sheet is also used instead of the recording paper P.

In order to further improve smoothness of the image surface after the fixation, it is desirable that the surface of the recording paper P is smooth, and for example, coated paper obtained by coating a surface of plain paper with a resin or the like, or art paper for printing is preferably used.

The paper P on which the fixation of a color image is completed, is discharged towards a discharging unit, and a sequence of a color image forming operation ends.

Cleaning Unit and Cleaning Blade

Hereinafter, a configuration example of the photoreceptor cleaning devices 6Y, 6M, 6C, and 6K included in the image forming apparatus shown in FIG. 1 will be described with reference to the drawings.

Figure 2:
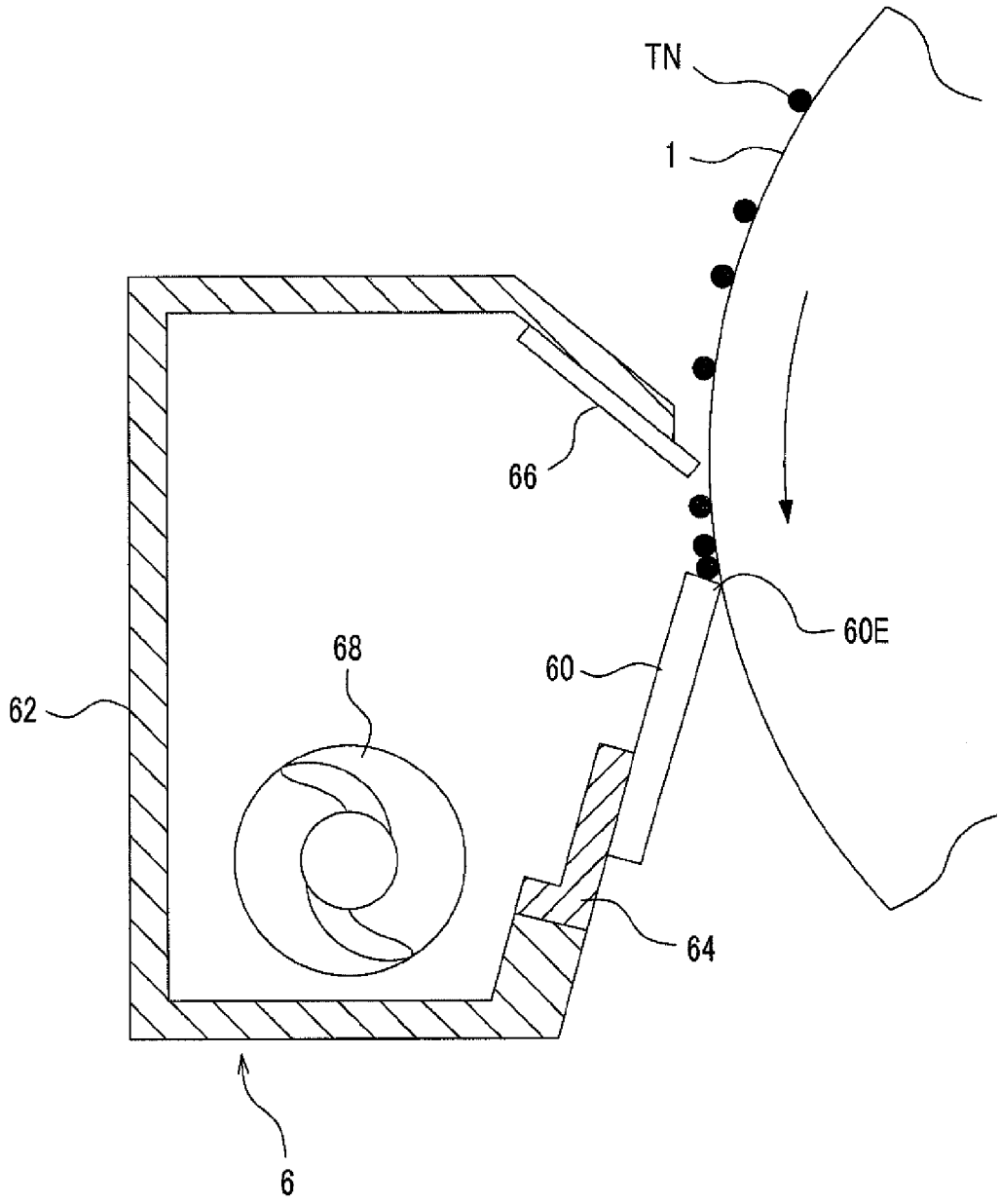
FIG. 2 is a schematic configuration diagram showing an example of a cleaning device of an image forming apparatus according to the exemplary embodiment.

FIG. 2 is a schematic configuration diagram showing an example of the photoreceptor cleaning device, and is a diagram showing a state in which the cleaning blade contacts with the photoreceptor.

In a photoreceptor cleaning device 6 shown in FIG. 2, a cleaning blade 60 contacts with a surface (periphery surface) of a photoreceptor 1 at least when the image forming apparatus performs the image formation, and scrapes residual toner TN after transfer from the photoreceptor 1.

The photoreceptor cleaning device 6 has a housing 62 which opens to a side opposing the surface of the photoreceptor 1.

On an inner surface of an opening end portion on the upper portion of the housing 62, for example, a sealing member 66 which prevents leakage of waste toner accommodated in the photoreceptor cleaning device 6 to the outside is disposed along an axial direction of the photoreceptor 1. The sealing member 66 has a configuration of not coming into contact with the photoreceptor 1, while extending towards the photoreceptor 1 so as to cover a gap between the photoreceptor 1 and the housing 62. A polyurethane sheet having a thickness of 0.2 mm, for example, is used as the sealing member 66.

A screw 68 which carries the collected waste toner to a waste toner discharging unit (not shown) which is provided outside of the housing 62, for example, is provided on the lower side in the housing 62.

The cleaning blade 60 is disposed along the axial direction of the photoreceptor 1, on the external face of the opening end portion on the lower side of the housing 62.

The cleaning blade 60 is a plate-shaped (blade-shaped) member, and is fixed to the housing 62 through a support member 64 (for example, metal plate). The cleaning blade 60 and the support member 64 are fixed to each other with an adhesive, for example, and the support member 64 and the housing 62 are fixed to each other with a screw, for example. The cleaning blade 60 may be directly attached to the housing 62 without the support member 64.

For example, an end (end on a closer side of the photoreceptor 1) of the cleaning blade 60 on a distant side from the support member 64 is disposed in a state of facing a side opposite a rotation direction of the photoreceptor 1, and an edge portion 60E of the cleaning blade 60 contacts with the photoreceptor 1.

In the exemplary embodiment, it is considered that the hydrophobic inorganic oxide particles are aggregated in front of a region (blade nip) in which the cleaning blade 60 contacts with the photoreceptor 1, to form an aggregate layer, and this aggregate layer improves the cleaning property of the photoreceptor 1 performed by the cleaning blade 60.

Figure 3:
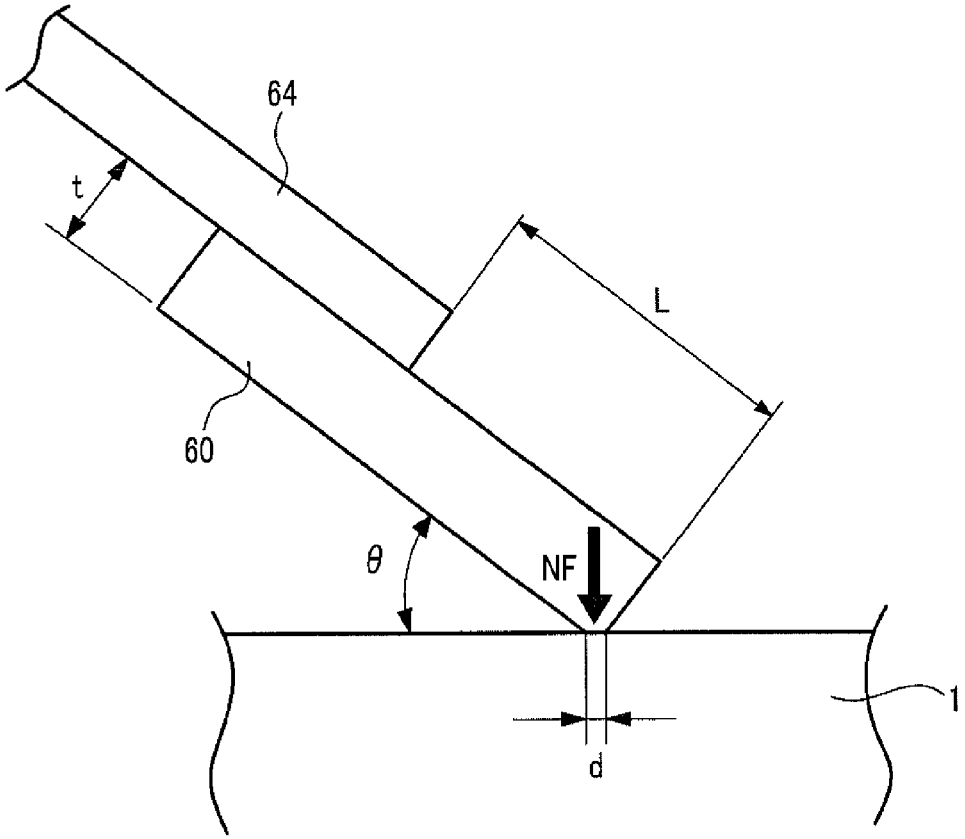
FIG. 3 is a schematic diagram of an enlarged portion in which a cleaning blade of a cleaning device of an image forming apparatus according to the exemplary embodiment contacts with an image holding member.

FIG. 3 is a schematic diagram of an enlarged portion in which the cleaning blade 60 contacts with the photoreceptor 1.

Contact pressure NF (pressure applied to a radial direction of the photoreceptor 1) of the cleaning blade 60 is in a range of 9.8 mN/mm to 21.6 mN/mm, and, from a viewpoint of obtaining a longer lifetime of the photoreceptor 1, is preferably from 10.8 mN/mm to 19.6 mN/mm, and more preferably from 11.8 mN/mm to 17.6 mN/mm.

A thickness t of the cleaning blade 60 is, for example, from 1.8 mm to 2.2 mm and is preferably from 1.9 mm to 2.1 mm.

A free length L of the cleaning blade 60 (width of cleaning blade not fixed to the support member 64) is, for example, from 7 mm to 13 mm and preferably from 8 mm to 12 mm.

A contact angle θ of the cleaning blade 60 is, for example, from 15° to 35° and is preferably from 20° to 30°.

A contact width d of the cleaning blade 60 is, for example, from 0.5 mm to 1.5 mm and is preferably from 0.8 mm to 1.2 mm.

The cleaning blade 60 is configured with an elastic material, for example. As the elastic material, thermosetting polyurethane rubber, silicone rubber, fluorine rubber, ethylene propylene diene rubber, or the like is used, for example. Among these, from a viewpoint of excellent mechanical properties such as abrasion resistance, defect resistance, creep resistance, or the like, the thermosetting polyurethane rubber is desirable at least as a member configuring the edge portion 60E (preferably as a member configuring the entire cleaning blade).

Hardness of the member configuring the cleaning blade 60 is, for example in a Young's modulus, from 6.86 $N/mm^2$ to 9.80 $N/mm^2$ and is preferably from 7.84 $N/mm^2$ to 8.82 $N/mm^2$.

In the cleaning blade 60, the following Formula (3) is satisfied by the contact pressure NF, the Young's modulus E, the thickness t, the contact width d, and the free length L.

$$NF(\text{mN/mm})=1000\times E\times t^3\times d/4L^3 \qquad \text{Formula (3):}$$

As a pressurizing method of the cleaning blade 60 with respect to the photoreceptor 1, a constant displacement method with a simple structure and low cost may be employed, and a constant load method with small contact pressure change over time may be employed.

The photoreceptor cleaning device 6 is unitized as a single body, and may be configured to be detachable from the image forming apparatus. In addition, the photoreceptor cleaning device 6 is at least integrated with the photoreceptor 1, and may be configured as a photoreceptor unit (image holding member unit) which is detachable from the image forming apparatus in that state.

Electrostatic Charge Image Developer

Hereinafter, the electrostatic charge image developer applied to the image forming apparatus according to the exemplary embodiment will be described.

The electrostatic charge image developer may be a single-component developer including only toner or may be a two-component developer obtained by mixing toner and a carrier.

Toner

The toner contains the toner particles having the shape factor SF1 of 120 to 145 and the hydrophobic inorganic oxide particles having the number average particle diameter of 30 nm to 80 nm, and satisfies the following Formula (1).

$$Q\geq 160-12R \qquad \text{Formula (1):}$$

In Formula (1), Q represents the shape factor SF1 of the toner particles and R represents content (% by weight) of the hydrophobic inorganic oxide particles in the toner.

Toner Particles

The toner particle contains a binder resin and a colorant, for example, and also may further contain a release agent or the other internal additives.

Hereinafter, components contained in the toner particle will be described in detail.

Binder Resin

Examples of the binder resin include a homopolymer and a copolymer of, for example, styrenes (for example, styrene, p-chlorostyrene, α-methyl styrene, or the like), ester (meth) acrylates (for example, methyl (meth)acrylate, ethyl (meth) acrylate, n-propyl (meth)acrylate, n-butyl (meth)acrylate, lauryl (meth)acrylate, 2-ethylhexyl (meth)acrylate, or the like), ethylenic unsaturated nitriles (for example, (meth) acrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), and olefins (for example, ethylene, propylene, butadiene, or the like).

Examples of the representative binder resin include a polyester resin, an epoxy resin, a polyurethane resin, a polyamide resin, a cellulose resin, a polyether resin, polystyrene, a styrene-alkyl (meth)acrylate copolymer, a styrene-(meth)acrylonitrile copolymer, a styrene-butadiene copolymer, and a styrene-maleic anhydride copolymer.

The resins may be used alone or in combination of two or more kinds.

As the binder resin, the polyester resin is preferable.

Examples of the polyester resin include a polycondensation of polycarboxylic acid and polyol. A commercially available polyester resin may be used or a synthesized polyester resin may be used.

Examples of the polycarboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, sebacic acid, or the like), alicyclic dicarboxylic acid (for example, cyclohexane dicarboxylic acid or the like), aromatic dicarboxylic acid (for example, terephthalic acid, isophthalic acid, phthalic acid, naphthalene dicarboxylic acid, or the like), an anhydride thereof, or a lower (for example, having 1 to 5 carbon atoms) alkyl ester thereof. Among these, aromatic dicarboxylic acid is desirable as the polycarboxylic acid, for example.

As the polycarboxylic acid, dicarboxylic acid and trivalent or higher-valent carboxylic acid to form a cross-linked structure or a branched structure may be used in combination. Examples of the trivalent or higher-valent carboxylic acid include trimellitic acid, pyromellitic acid, an anhydride thereof, or a lower (for example, having 1 to 5 carbon atoms) alkyl ester thereof.

The polycarboxylic acid may be used alone or in combination of two or more kinds.

Examples of the polyol include an aliphatic diol (for example, ethylene glycol, diethylene glycol, triethylene glycol, propylene glycol, butanediol, hexanediol, neopentyl glycol, or the like), an alicyclic diol (for example, cyclohexane died, cyclohexanedimethanol, hydrogenated bisphenol A, or the like), an aromatic diol (for example, ethylene oxide adduct of bisphenol A, propylene oxide adduct of bisphenol A, or the like). Among these, as the polyol, for example, the aromatic dial and the alicyclic dial are desirable and the aromatic dial is more desirable.

As the polyol, the dial and a trivalent or higher-valent alcohol having a cross-linked structure or a branched structure may be used in combination. Examples of the trivalent or higher-valent alcohol include glycerol, trimethylolpropane, pentaerythritol, and the like.

The polyol may be used alone or in combination of two or more kinds.

A glass transition temperature (Tg) of the polyester resin is preferably from 50° C. to 80° C. and more preferably from 50° C. to 65° C.

The glass transition temperature is acquired with a DSC curve obtained by differential scanning calorimetry (DSC). In detail, the glass transition temperature is measured with a "extrapolated glass transition starting temperature" disclosed in a measuring method of the glass transition temperature based on "Testing methods for transition temperatures of plastics" of JIS K7121-1987.

Weight-average molecular weight (Mw) of the polyester resin is preferably from 5,000 to 1,000,000 and more preferably from 7,000 to 500,000.

Number average molecular weight (Mn) of the polyester resin is preferably from 2,000 to 100,000.

Molecular weight distribution Mw/Mn of the polyester resin is preferably from 1.5 to 100 and more preferably from 2 to 60.

The weight-average molecular weight and the number average molecular weight of the resin are measured by gel permeation chromatography (GPC). The molecular weight measurement is performed by GPC, using HLC-8120 manufactured by Tosoh Corporation as a measuring apparatus, TSKgel SuperHM-M 15 cm manufactured by Tosoh Corporation as a column, and tetrahydrofuran as a solvent. The weight-average molecular weight and the number average molecular weight are calculated using a molecular weight calibration curve created by a monodispersed polystyrene standard sample from the measurement result.

Content of the binder resin contained in the toner particles is preferably from 40% by weight to 95% by weight, more preferably from 50% by weight to 90% by weight, and even more preferably from 60% by weight to 85% by weight.

Colorant

A colorant contained in the toner particles may be a pigment or a dye. The colorant may be used alone or in combination of two or more kinds.

Examples of the colorant include Carbon Black, Nigrosine, Aniline Blue, Calcoil Blue, Chrome Yellow, Ultramarine Blue, Dupont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, C.I. Pigment Blue 15:3, and the like.

As the colorant, a surface-treated colorant may be used or a dispersant may be used in combination, if necessary.

Content of the colorant is preferably from 1% by weight to 30% by weight of the toner particles and more preferably from 3% by weight to 15% by weight.

Release Agent

The toner particles may contain a release agent. The release agent may be used alone or in combination of two or more kinds.

Examples of the release agent include paraffin wax and a derivative thereof, montan wax and a derivative thereof, microcrystalline wax and a derivative thereof, Fischer-Tropsch wax and a derivative thereof, polyolefin wax and a derivative thereof, low molecular weight polypropylene, low molecular weight polyethylene, high molecular alcohol, fatty acid, vegetable wax, animal wax, mineral wax, ester waxes, acid amide, and the like. The derivative includes an oxide and polymer of a vinyl monomer, and a graft-modified product.

A melting temperature of the release agent is preferably from 50° C. to 110° C. and more preferably from 60° C. to 100° C.

The melting temperature is measured by a "melting peak temperature" disclosed in a measuring method of the melting temperature based on "Testing methods for transition temperatures of plastics" of JIS K-1987, from the DSC curve obtained by differential scanning calorimetry (DSC).

Content of the release agent is preferably from 1% by weight to 20% by weight of the toner particles and more preferably from 5% by weight to 15% by weight.

Other Component

Examples of the other component internally added in the toner particles include a well-known additive such as a magnetic material, a charge-controlling agent, inorganic particles, and the like.

Properties of Toner Particles

The toner particles may be toner particles having a single-layered structure, and may be toner particles having a so-called core shell structure configured with a core portion (core particle) and a coating layer (shell layer) which coats the core portion. The toner particles having a core shell structure is preferably configured with a core portion which is configured by containing a binder resin, a colorant, and, if necessary, another additive such as a release agent, and a coating layer which is configured by containing a binder resin, for example.

A volume average particle diameter (D50v) of the toner particles is preferably from 2 μm to 10 μm and more preferably from 4 μm to 8 μm.

The volume average particle diameter (D50v) of the toner particles is measured by using Coulter Multisizer II (manufactured by Beckman Coulter, Inc., an aperture diameter of 100 μm).

0.5 mg to 50 mg of the toner particles are added to 2 mL of 5 weight % aqueous solution of a surfactant (preferably sodium alkylbenzene sulfonate), the resultant material is added to 100 mL to 150 mL of an electrolyte (Isoton II manufactured by Beckman Coulter, Inc.), a dispersing process is performed for 1 minute with ultrasonic dispersion equipment, and accordingly a test sample is prepared.

Using the devices and the test sample, particle diameters of 50,000 particles having a diameter of 2 μm to 60 μm are measured, a cumulative distribution of volume from the smaller diameter is drawn, and the particle diameter with accumulation of 50% is set to the volume average particle diameter (D50v).

Hydrophobic Inorganic Oxide Particles

The toner contains the hydrophobic inorganic oxide particles having a number average particle diameter of 30 nm to 80 nm. The hydrophobic inorganic oxide particles are inorganic oxide particles, surfaces of which are subjected to hydrophobic treatment.

Examples of the inorganic oxide particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, and the like.

The hydrophobic treatment of the inorganic oxide particles is performed by a well-known method of dipping the inorganic oxide particles in a hydrophobization treatment agent, for example. The hydrophobization treatment agent is not particularly limited, and examples thereof include a silane coupling agent, silicone oil, a titanate coupling agent, an aluminum coupling agent, and the like. The components may be used alone or in combination of two or more kinds.

An amount of the hydrophobization treatment agent is, for example, from 1 part by weight to 10 parts by weight with respect to 100 parts by weight of the inorganic oxide particles.

As the hydrophobic inorganic oxide particles, hydrophobic silica ($SiO_2$) particles are desirable, and silica particles obtained by performing surface treatment with an organosilicon compound (for example, alkoxysilane, silazane, silicone oil, and the like) are desirable. Among these, silica particles obtained by performing surface treatment with silicone oil are more desirable in that the particles are aggregated on the portion right in front of the blade nip and easily form an aggregate layer.

The number average particle diameter of the hydrophobic inorganic oxide particles is from 30 nm to 80 nm. If the number average particle diameter of the hydrophobic inorganic oxide particles is equal to or more than 30 nm, burying with respect to the toner particles is suppressed and a spacer function is easily secured. If the number average particle diameter of the hydrophobic inorganic oxide particles is equal to or less than 80 nm, detachment from the toner particles is suppressed, defect due to mechanical load is easily suppressed, and as a result, the spacer function is easily secured.

In addition, if the number average particle diameter of the hydrophobic inorganic oxide particles is from 30 nm to 80 nm, the particles are aggregated in front of the blade nip and easily form an aggregate layer.

Other External Additive

As the external other additive, a well-known additive such as a resin particle (resin particle of polystyrene, PMMA, melamine resin), a cleaning activator (for example, a metal salt of higher fatty acids typified by zinc stearate and particles of fluorine polymer).

Manufacturing Method of Toner

The toner applied to the exemplary embodiment is obtained by preparing the toner particles and externally adding the external additive such as the hydrophobic inorganic oxide particles to the toner particles.

The toner particles may be prepared by any of a dry preparation method (for example, a kneading and pulverizing method), and a wet preparing method (for example, the aggregation and coalescence method, a suspension polymerization method, or a dissolution and suspension method). The preparing methods are not particularly limited and the well-known preparing method is employed. Among these, it is desirable to obtain the toner particles by the aggregation and coalescence method.

In detail, when preparing the toner particles by the aggregation and coalescence method, for example, the toner particles are prepared by performing a step (resin particle dispersion preparing step) of preparing a resin particle dispersion in which resin particles which are a binder resin is dispersed, a step (colorant dispersion preparing step) of preparing a colorant dispersion in which colorant particles are dispersed, a step (aggregated particle forming step) of aggregating resin particles and a colorant (also other particles if necessary) in the dispersion obtained by mixing the resin particle dispersion and the colorant dispersion (also mixing with the other particle dispersion if necessary) and forming aggregated particles, and a step (coalescence step) of heating the aggregated particle dispersion in which the aggregated particles are dispersed, performing coalescence of the aggregated particles, and forming the toner particles.

Hereinafter, each step of the aggregation and coalescence method will be described in detail.

In the following description, the method of obtaining the toner particles which also contain the release agent will be described, but the release agent is used if necessary. Of course, another additive other than the release agent may be used.

Resin Particle Dispersion Preparing Step

First, the resin particle dispersion in which the resin particle which is the binder resin is dispersed is prepared.

The resin particle dispersion is prepared by dispersing the resin particle in a dispersion medium by a surfactant, for example.

An aqueous medium is used, for example, as the dispersion medium used in the resin particle dispersion.

Examples of the aqueous medium include water such as distilled water, ion exchange water, or the like; alcohols; and the like. The medium may be used alone or in combination of two or more kinds.

Examples of the surfactant include an anionic surfactant such as a sulfuric ester salt, sulfonate, phosphate ester, or soap; a cationic surfactant such as amine salt, or quaternary ammonium salt; and a nonionic surfactant such as polyethyleneglycol, alkylphenol ethylene oxide adduct, or polyols. Among these, the anionic surfactant and the cationic surfactant are particularly used. The nonionic surfactant may be used in combination with the anionic surfactant or the cationic surfactant.

The surfactant may be used alone or in combination of two or more kinds.

As a method of dispersing the resin particle in the dispersion medium, a typical dispersing method using a rotating shear type homogenizer, a ball mill, a sand mill, or a DYNO-mill having media is used. According to the type of the resin particle, the resin particle may be dispersed in the dispersion medium using a phase-transfer emulsification method, for example.

The phase-transfer emulsification method is a method of dissolving the resin to be dispersed in a hydrophobic organic solvent in which the resin is soluble, neutralizing the solution by adding a base to the organic continuous phase (O phase), and then putting water (W phase) therein, performing phase transfer from W/O to O/W, and dispersing the resin in a particle shape in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

The volume average particle diameter of the resin particles is obtained by drawing the cumulative distribution of volume from the smaller diameter with respect to the divided particle size range (channel), using the particle size distribution obtained by measurement with a laser diffraction type particle size distribution measuring device (for example, LA-700 manufactured by Horiba, Ltd.). The particle diameter with 50% volume with respect to the entirety of the particles is set to a volume average particle diameter D50p. In addition, the volume average particle diameter of the particle in the other dispersion is also measured in the same manner.

Content of the resin particles contained in the resin particle dispersion is preferably from 5% by weight to 50% by weight and more preferably from 10% by weight to 40% by weight.

Colorant Dispersion Preparing Step

The colorant dispersion in which the colorant particle is dispersed is prepared in the same method as the preparing method of the resin particle dispersion. That is, the dispersion medium, the surfactant, the dispersing method, the volume average particle diameter of particles, and the particle content of the colorant dispersion are the same as those of the resin particle dispersion. In addition, colorant-containing resin particle dispersion in which the colorant is dispersed in the resin particle may be used instead of the colorant dispersion.

In addition, a release agent dispersion in which a release agent particle is dispersed, is also prepared in the same method as the preparing method of the resin particle dispersion. That is, the dispersion medium, the surfactant, the dispersing method, the volume average particle diameter of particles, and the particle content of the release agent dispersion are the same as those of the resin particle dispersion. In addition, a release agent-containing resin particle dispersion in which the release agent is dispersed in the resin particle may be used instead of the release agent dispersion.

Aggregated Particle Forming Step

Next, the resin particle dispersion, the colorant dispersion, and the release agent dispersion are mixed.

Then, the resin particle, the colorant particle, and the release agent particle are subjected to heteroaggregation in the mixed dispersion, and an aggregated particle containing the resin particle, the colorant particle, and the release agent particle having a diameter close to the target diameter of the toner particle is formed.

In detail, for example, an aggregating agent is added to the mixed dispersion and pH of the mixed dispersion is adjusted to be acidic (for example, from pH 2 to 5), a dispersion stabilizer is added if necessary, and then the resultant material is heated to a temperature (in detail, for example, from a temperature which is 30° C. lower than the glass transition temperature of the resin particle to a temperature which is 10° C. lower than the glass transition temperature) close to the glass transition temperature of the resin particle, and the particle dispersed in the mixed dispersion is aggregated to form the aggregated particle.

In the aggregated particle forming step, for example, while stirring the mixed dispersion with a rotating shear type homogenizer, the aggregating agent is added at room temperature (for example, 25° C.), pH of the mixed dispersion is adjusted to be acidic (for example, from pH 2 to 5), the dispersion stabilizer is added if necessary, and then the heating may be performed.

As the aggregating agent, for example, a surfactant having polarity opposite to the surfactant contained in the mixed dispersion, for example, inorganic metal salt or a divalent or higher-valent metal complex is used. When using the metal complex as the aggregating agent, the used amount of the aggregating agent is decreased and the charging property is improved.

An additive for forming a complex or a similar bond with a metal ion of the aggregating agent may be used, with the aggregating agent. A chelating agent is preferably used as the additive.

Examples of the inorganic metal salt include metal salts such as calcium chloride, calcium nitrate, barium chloride, magnesium chloride, zinc chloride, aluminum chloride, or aluminum sulfate; inorganic metal salt polymers such as polyaluminum chloride, polyaluminum hydroxide, calcium polysulfide; and the like.

A water-soluble chelating agent may be used as the chelating agent. Examples of the chelating agent include oxycarboxylic acid such as tartaric acid, citric acid, or gluconic acid; aminocarboxylic acid such as iminodiacetic acid (IDA), nitrilotriacetic acid (NTA), or ethylenediaminetetraacetic acid (EDTA); and the like.

The added amount of the chelating agent is, for example, preferably from 0.01 part by weight to 5.0 parts by weight with respect to the 100 parts by weight of the resin particles, and more preferably equal to or more than 0.1 part by weight and less than 3.0 parts by weight.

Coalescence Step

Next, the aggregated particle dispersion in which the aggregated particles are dispersed is heated to equal to or higher than the glass transition temperature of the resin particle (for example, temperature which is 10° C. to 30° C. higher than the glass transition temperature of the resin particle or higher), and is kept at this temperature, the aggregated particles are subjected to coalescence, and the toner particles are formed.

The time for keeping the aggregated particle dispersion in which the aggregated particles are dispersed at that temperature may be from 30 minutes to 6 hours, for example, and normally as the keeping time is longer in this range, the shape factor SF1 of the toner particle tends to be close to 100.

The toner particles are obtained by performing the above steps.

After obtaining the aggregated particle dispersion in which the aggregated particles are dispersed, a step of further mixing the aggregated particle dispersion and the resin particle dispersion in which the resin particles are dispersed, and performing aggregation so that the resin particles are further attached to the surface of the aggregated particles, to form second aggregated particles, and a step of heating the second aggregated particle dispersion in which the second aggregated particles are dispersed, performing coalescence of the second aggregated particles, and forming the toner particles having a core shell structure, are performed and the toner particles may be manufactured.

After completing the coalescence step, a well-known washing step, a solid-liquid separation step, and a drying step are performed for the toner particles formed in a solution and the toner particles in a dried state are obtained.

In the washing step, displacement washing by the ion exchange water is preferably performed sufficiently from a viewpoint of a charging property. The solid-liquid separation step is not particularly limited. However, suction filtration or pressurization filtration is preferably performed in a point of productivity. In addition, the method of the drying step is not particularly limited. However, freeze-drying, flash jet drying, fluidized drying, vibration type fluidized drying, or the like is preferably performed from a viewpoint of productivity.

The toner applied in the exemplary embodiment is manufactured, for example, by adding and mixing the external additive to the toner particles in the dried state. The mixing is preferably performed with a V-blender, a Henschel mixer, a Lödige mixer, or the like, for example. In addition, if necessary, the coarse particle of the toner may be removed using a vibration classifier or a wind classifier.

Carrier

The carrier is not particularly limited, and a well-known carrier may be used. Examples of the carrier include a coated carrier obtained by coating the surface of a core formed of magnetic particle with the resin; a magnetic particle dispersion type carrier obtained by dispersing and combining the magnetic particle in a matrix resin; a resin impregnation type carrier obtained by impregnating the resin in porous magnetic particle; and the like.

The magnetic particle dispersion type carrier and the resin impregnation type carrier may be carriers obtained by setting a configuration particle of the carrier to a core and coating the surface thereof with the resin.

Examples of the magnetic particle include magnetic metal such as iron, nickel, or cobalt; magnetic oxide such as ferrite or magnetite; and the like.

Examples of the conductive particles include metal such as gold, silver, or copper; particles of, for example, carbon black, titanium oxide, zinc oxide, tin oxide, barium sulfate, aluminum borate, or potassium titanate; and the like.

Examples of the resin for coating and the matrix resin include polyethylene, polypropylene, polystyrene, polyvinyl acetate, polyvinyl alcohol, polyvinyl butyral, polyvinyl chloride, polyvinyl ethers, polyvinyl ketones, a vinyl chloride-vinyl acetate copolymer, a styrene-acrylic acid copolymer, a straight silicone resin configured by containing an organosiloxane bond or a modified product thereof, a fluorine resin, polyester, polycarbonate, a phenol resin, an epoxy resin, and the like. The additive such as a conductive material may be contained in the resin for coating and the matrix resin.

In order to coat the surface of the core with the resin, a coating method performed with a solution for coating layer formation obtained by dissolving the resin for coating and various additives (used if necessary) in a suitable solvent, is used. The solvent is not particularly limited, but the solvent may be selected by considering the type of the resin to be used and the coating suitability.

Specific examples of the resin coating method include an dipping method of dipping the core in the solution for coating layer formation; a spray method of spraying the solution for coating layer formation onto the surface of the core; a fluidized bed method of spraying the solution for coating layer formation in a state where the core is floated in fluidized air; a kneader coater method of mixing the core of the carrier and the solution for coating layer formation in the kneader coater and then removing the solvent; and the like.

A mixing ratio (weight ratio) of the toner and the carrier in the two-component developer is preferably toner:carrier=1:100 to 30:100 and more preferably 3:100 to 20:100.

EXAMPLES

Hereinafter, the exemplary embodiment of the invention will be described with examples in more detail, but the exemplary embodiment of the invention is not limited to the examples.

In the following description, "part" is based on weight unless otherwise noted.

Preparation of Resin Particle Dispersion

| | |
|---|---|
| Terephthalic acid | 30 parts by mole |
| Fumaric acid | 70 parts by mole |
| Bisphenol A ethylene oxide adduct | 5 parts by mole |
| Bisphenol A propylene oxide adduct | 95 parts by mole |

The above materials are put in a 5-liter flask including a stirring device, a nitrogen inlet tube, a temperature sensor, and a rectifier, a temperature is increased to 220° C. for 1 hour, and 1 part of titanium tetraethoxide is added with respect to 100 parts of the materials. The temperature is increased to 230° C. for 0.5 hour while distilling the generated water, a dehydration condensation reaction is continued for 1 hour at this temperature, and then a reactant is cooled. Accordingly, a polyester resin (1) having a weight-average molecular weight of 18,000 and the glass transition temperature of 60° C. is synthesized.

40 parts of ethyl acetate and 25 parts of 2-butanol are put in a container including a temperature adjustment unit and a nitrogen substitution unit, a resultant material is set to a mixed solvent, and then 100 parts of the polyester resin (1) is slowly put and dissolved, and 10% by weight of ammonia aqueous solution (triple equivalent in molar ratio with respect to acid value of resin) is put therein and stirred for 30 minutes.

Then, the inside of the container is substituted with dry nitrogen, the temperature is kept at 40° C., 400 parts of the ion exchange water is added dropwise at a rate of 2 parts/min while stirring the mixed liquid, and emulsification is performed. After completing the dropwise addition, by returning the temperature of the emulsified liquid to room temperature (20° C. to 25° C.) and performing bubbling by the dry nitrogen for 48 hours while stirring, the concentration of the ethyl acetate and 2-butanol is decreased to 1,000 ppm or less, and the resin particle dispersion in which the resin particle having a volume average particle diameter of 200 nm is dispersed is obtained. The ion exchange water is added to the resin particle dispersion, and a solid amount is adjusted to 20% by weight to obtain the resin particle dispersion (1).

Preparation of Colorant Dispersion

| | |
|---|---|
| Cyan pigment (C.I. Pigment Blue 15:3 manufactured by Dainichiseika Color & Chemicals Mfg. Co., Ltd.) | 100 parts |
| Anionic surfactant (NEOGEN RK manufactured by Dai-Ichi Kogyo Seiyaku Co., Ltd.) | 1.5 parts |
| Ion exchange water | 400 parts |

The above materials are mixed and dispersed using a high-pressure impact type disperser ULTIMIZER (HJP30006 manufactured by SUGINO MACHINE LIMITED) for 1 hour, and colorant dispersion (1) in which the colorant particle is dispersed (solid amount of 20% by weight) is obtained. The volume average particle diameter of the colorant particle is 160 nm.

Preparation of Release Agent Dispersion

| | |
|---|---|
| Paraffin wax (HNP-9 manufactured by Nippon Seiro Co., Ltd.) | 100 parts |
| Anionic surfactant (NEOGEN RK manufactured by Dai-Ichi Kogyo Seiyaku Co., Ltd.) | 1 part |
| Ion exchange water | 400 parts |

The above materials are mixed, heated to 100° C., dispersed using a homogenizer (ULTRA-TURRAX T50 manufactured by IKA, Ltd.), and then are subjected to dispersion treatment with Manton-Gaulin high pressure homogenizer (manufactured by Gaulin Co., Ltd.), and release agent dispersion (1) in which the release agent particle is dispersed (solid amount of 20% by weight) is obtained. The volume average particle diameter of the release agent particle is 200 nm.

Preparation of Toner Particles

Preparation of Toner Particle (1)

| | |
|---|---|
| Resin particle dispersion (1) | 310 parts |
| Colorant dispersion (1) | 40 parts |
| Release agent dispersion (1) | 50 parts |
| Anionic surfactant (Tayca Power BN2060 manufactured by Tayca Corporation, 20% by weight aqueous solution) | 2 parts |

The above materials are put in a round stainless flask, and are dispersed using a homogenizer (ULTRA-TURRAX T50 manufactured by IKA, Ltd.). Next, 0.1 N of nitric acid is added to adjust pH to 3.5, and then 30 parts of nitric acid aqueous solution having a polyaluminum chloride concentration of 10% by weight is added. Then, after dispersing at 30° C. using the homogenizer, the resultant material is heated to 45° C. in an oil bath for heating and retained for 30 minutes. After that, 100 parts of the resin particle dispersion (1) is slowly added and the resultant material is kept for 1 hour.

Then, after adding 0.1 N of aqueous sodium hydroxide to adjust pH to 8.5, the resultant material is heated to 85° C. while continuing the stirring, and kept for 5 hours. After confirming the coalescence of the aggregated particle with an optical microscope, the resultant material is cooled to 20° C. at a rate of 1° C./min.

After cooling, the particle is filtered, is sufficiently washed with the ion exchange water, and dried, to obtain a toner particle (1). The volume average particle diameter of the toner particle (1) is 7.5 μm and the shape factor SF1 thereof is 122.

Preparation of Toner Particles (2) to (4)

Toner particles (2) to (4) are prepared in the same manner as the preparation of the toner particle (1) except for changing the temperature and the keeping time in the coalescence step as shown in Table 1. The volume average particle diameter and the shape factor SF1 of each toner particle are shown in Table 1.

Preparation of Developer

Preparation of Developer (1)

Preparation of Externally Added Toner

The toner particle (1) and a silica particle (RY50 manufactured by Nippon Aerosil Co., Ltd.) the surface of which is subjected to hydrophobic treatment with dimethyl silicone oil are mixed with each other using the Henschel mixer, and toner (1) in which the content of the hydrophobic silica particle in the toner is 3.3% by weight is obtained.

When observing 100 hydrophobic silica particles existing on the surface of the toner particle with the scanning electron microscope (SEM) and acquiring the number average particle diameter based on the method described above, the number average particle diameter is 50 nm.

Mixing of Carrier and Toner

| | |
|---|---|
| Ferrite particle (average particle diameter of 50 μm) | 100 parts |
| Toluene | 14 parts |
| Styrene-methyl methacrylate copolymer (copolymerization ratio of 15/85) | 2 parts |
| Carbon black | 0.2 part |

The above materials except the ferrite particle are dispersed in a sand mill to prepare dispersion, and the dispersion is put in a vacuum deaeration type kneader with the ferrite particle, and is depressurized and dried while stirring, to obtain a carrier.

5 parts of the toner (1) is mixed with respect to 100 parts of the carrier to obtain a developer (1).

Preparation of Developers (2) to (8)

Preparation of Externally Added Toner

Toners (2) to (8) are obtained in the same manner as the preparation of the toner (1), except for using the toner particles (2) to (4) instead of the toner particle (1) and changing the content of the hydrophobic silica particle as shown in Table 1.

Mixing of Carrier and Toner

Developers (2) to (8) are obtained in the same manner as the preparation of the developer (1), except for using the toners (2) to (8) instead of the toner (1).

TABLE 1

| | | | Properties of toner particle | | Preparation condition of toner particle | |
|---|---|---|---|---|---|---|
| | Content of | | Shape | Volume average | Coalescence step | |
| Toner/ developer | hydrophobic silica particle | Toner particle | factor SF1 | particle diameter | Temperature | Keeping time |
| (1) | 3.3% by weight | (1) | 122 | 7.5 μm | 85° C. | 5 hours |
| (2) | 3.0% by weight | (1) | 122 | 7.5 μm | 85° C. | 5 hours |
| (3) | 2.9% by weight | (2) | 127 | 7.5 μm | 80° C. | 3 hours |
| (4) | 2.5% by weight | (2) | 127 | 7.5 μm | 80° C. | 3 hours |
| (5) | 2.0% by weight | (3) | 138 | 7.5 μm | 75° C. | 3 hours |
| (6) | 1.6% by weight | (3) | 138 | 7.5 μm | 75° C. | 3 hours |
| (7) | 1.7% by weight | (4) | 142 | 7.5 μm | 75° C. | 2.5 hours |
| (8) | 1.3% by weight | (4) | 142 | 7.5 μm | 75° C. | 2.5 hours |

Preparation of Image Forming Apparatuses (A-1) to (A-8)

DocuPrint P450 ps (manufactured by Fuji Xerox Co., Ltd.) which is an image forming apparatus including the same configuration as that shown in FIG. 1 is prepared, and the following cleaning blade is fixed thereto.

Cleaning blade: formed of thermosetting polyurethane rubber, Young's modulus of 8.4 N/mm$^2$, thickness of 2.0 mm, and free length of 11 mm The cleaning blade is disposed so as to have the contact angle of 23° and the contact width of 1.01 mm with respect to the photoreceptor, and the contact pressure is set to 12.7 mN/mm.

Any one kind of the developers (1) to (8) and any one kind of the toners (1) to (8) are put in a developing unit and a toner cartridge of the image forming apparatus, to prepare the image forming apparatuses (A-1) to (A-8).

Preparation of Image Forming Apparatuses (B-1) to (B-8)

DocuPrint P450 ps (manufactured by Fuji Xerox Co., Ltd.) which is an image forming apparatus including the same configuration as that shown in FIG. 1 is prepared, and the following cleaning blade is fixed thereto.

Cleaning blade: formed of thermosetting polyurethane rubber, Young's modulus of 8.4 N/mm$^2$, thickness of 2.0 mm, and free length of 9.5 mm The cleaning blade is disposed so as to have the contact angle of 23° and the contact width of 1.0 mm with respect to the photoreceptor, and the contact pressure is set to 19.6 mN/mm.

Any one kind of the developers (1) to (8) and any one kind of the toners (1) to (8) are put in a developing unit and a toner cartridge of the image forming apparatus, to prepare the image forming apparatuses (B-1) to (B-8).

Preparation of Image Forming Apparatuses (C-1) to (C-8)

DocuPrint P450 ps (manufactured by Fuji Xerox Co., Ltd.) which is an image forming apparatus including the same configuration as that shown in FIG. 1 is prepared, and the following cleaning blade is fixed thereto.

Cleaning blade: formed of thermosetting polyurethane rubber, Young's modulus of 8.4 N/mm$^2$, thickness of 2.0 mm, and free length of 11 mm The cleaning blade is disposed so as to have the contact angle of 23° and the contact width of 0.62 mm with respect to the photoreceptor, and the contact pressure is set to 7.8 mN/mm.

Any one kind of the developers (1) to (8) and any one kind of the toners (1) to (8) are put in a developing unit and a toner cartridge of the image forming apparatus, to prepare the image forming apparatuses (C-1) to (C-8).

Preparation of image forming apparatuses (D-1) to (D-8)

DocuPrint P450 ps (manufactured by Fuji Xerox Co., Ltd.) which is an image forming apparatus including the same configuration as that shown in FIG. 1 is prepared, and the following cleaning blade is fixed thereto.

Cleaning blade: formed of thermosetting polyurethane rubber, Young's modulus of 8.4 N/mm$^2$, thickness of 2.0 mm, and free length of 9.5 mm The cleaning blade is disposed so as to have the contact angle of 23° and the contact width of 1.25 mm with respect to the photoreceptor, and the contact pressure is set to 24.5 mN/mm.

Any one kind of the developers (1) to (8) and any one kind of the toners (1) to (8) are put in a developing unit and a toner cartridge of the image forming apparatus, to prepare the image forming apparatuses (D-1) to (D-8).

Evaluation 5,000 images (image unit Cin 100% and image density 10%) are formed in an A4 size in an environment of a temperature of 20° C. and humidity of 10%, and passing through of the toner from the cleaning blade, filming of the surface of the photoreceptor, and the lifetime of the photoreceptor are evaluated as follows. The results thereof are shown in Table 2.

Passing Through of Toner

A portion from the downstream of the cleaning blade to the upstream of the charging device on the surface of the photoreceptor is visually observed, and presence or absence of the passing through of the toner is evaluated based on the following criteria.

A: passing through of toner is not recognized.

B: passing through of toner is recognized.

C: passing through of toner is noticeably recognized.

Filming

The surface of the photoreceptor is visually observed and presence or absence of a film-like attachment is evaluated based on the following criteria.

A: a film-like attachment is not recognized.

B: a film-like attachment is recognized but an area thereof is less than 1% of a toner image forming region.

C: a film-like attachment is recognized and an area thereof is equal to or more than 1% and less than 5% of a toner image forming region.

D: a film-like attachment is extensively recognized and an area thereof is equal to or more than 5% of a toner image forming region.

Lifetime of Photoreceptor

The lifetime is converted from an abrasion amount of the photoreceptor at a time point when 5,000 images are formed, and is evaluated based on the following criteria.

A: equal to or more than 100,000

B: equal to or more than 70,000 and less than 100,000

C: since a filming area is equal to or more than 1% and less than 5% (evaluation of filming: C) of a toner image forming region at the time point when 5,000 images are formed, the lifetime is determined as less than 50,000.

D: since a filming area is equal to or more than 5% (evaluation of filming: D) of a toner image forming region at the time point when 5,000 images are formed, the lifetime is determined as less than 50,000.

TABLE 2

| Image forming apparatus | Contact pressure of cleaning blade [mN/mm] | Toner/ developer | Q: shape factor SF1 of toner particle | R: content of hydrophobic silica particle [% by weight] | 160-12R | Note | Passing through of toner | Filming | Lifetime |
|---|---|---|---|---|---|---|---|---|---|
| C-1 | 7.8 | (1) | 122 | 3.3 | 120.4 | Com. Ex. | C | D | D |
| C-2 | 7.8 | (2) | 122 | 3.0 | 124.0 | Com. Ex. | C | D | D |
| C-3 | 7.8 | (3) | 127 | 2.9 | 125.2 | Com. Ex. | C | D | D |
| C-4 | 7.8 | (4) | 127 | 2.5 | 130.0 | Com. Ex. | C | D | D |
| C-5 | 7.8 | (5) | 138 | 2.0 | 136.0 | Com. Ex. | C | D | D |
| C-6 | 7.8 | (6) | 138 | 1.6 | 140.8 | Com. Ex. | C | D | D |
| C-7 | 7.8 | (7) | 142 | 1.7 | 139.6 | Com. Ex. | C | D | D |
| C-8 | 7.8 | (8) | 142 | 1.3 | 144.4 | Com. Ex. | C | D | D |
| A-1 | 12.7 | (1) | 122 | 3.3 | 120.4 | Present Invention | A | B | A |
| A-2 | 12.7 | (2) | 122 | 3.0 | 124.0 | Com. Ex. | B | C | C |
| A-3 | 12.7 | (3) | 127 | 2.9 | 125.2 | Present Invention | A | A | A |
| A-4 | 12.7 | (4) | 127 | 2.5 | 130.0 | Com. Ex. | B | C | C |
| A-5 | 12.7 | (5) | 138 | 2.0 | 136.0 | Present Invention | A | A | A |
| A-6 | 12.7 | (6) | 138 | 1.6 | 140.8 | Com. Ex. | B | C | C |
| A-7 | 12.7 | (7) | 142 | 1.7 | 139.6 | Present Invention | A | B | A |
| A-8 | 12.7 | (8) | 142 | 1.3 | 144.4 | Com. Ex. | B | C | C |
| B-1 | 19.6 | (1) | 122 | 3.3 | 120.4 | Present Invention | A | B | B |
| B-2 | 19.6 | (2) | 122 | 3.0 | 124.0 | Com. Ex. | B | C | C |
| B-3 | 19.6 | (3) | 127 | 2.9 | 125.2 | Present Invention | A | A | B |
| B-4 | 19.6 | (4) | 127 | 2.5 | 130.0 | Com. Ex. | B | C | C |
| B-5 | 19.6 | (5) | 138 | 2.0 | 136.0 | Present Invention | A | A | B |
| B-6 | 19.6 | (6) | 138 | 1.6 | 140.8 | Com. Ex. | B | C | C |
| B-7 | 19.6 | (7) | 142 | 1.7 | 139.6 | Present Invention | A | B | B |
| B-8 | 19.6 | (8) | 142 | 1.3 | 144.4 | Com. Ex. | B | C | C |
| D-1 | 24.5 | (1) | 122 | 3.3 | 120.4 | Com. Ex. | A | D | D |
| D-2 | 24.5 | (2) | 122 | 3.0 | 124.0 | Com. Ex. | A | D | D |

TABLE 2-continued

| Image forming apparatus | Contact pressure of cleaning blade [mN/mm] | Toner/ developer | Q: shape factor SF1 of toner particle | R: content of hydrophobic silica particle [% by weight] | 160-12R | Note | Passing through of toner | Filming | Lifetime |
|---|---|---|---|---|---|---|---|---|---|
| D-3 | 24.5 | (3) | 127 | 2.9 | 125.2 | Com. Ex. | A | D | D |
| D-4 | 24.5 | (4) | 127 | 2.5 | 130.0 | Com. Ex. | A | D | D |
| D-5 | 24.5 | (5) | 138 | 2.0 | 136.0 | Com. Ex. | A | D | D |
| D-6 | 24.5 | (6) | 138 | 1.6 | 140.8 | Com. Ex. | A | D | D |
| D-7 | 24.5 | (7) | 142 | 1.7 | 139.6 | Com. Ex. | A | D | D |
| D-8 | 24.5 | (8) | 142 | 1.3 | 144.4 | Com. Ex. | A | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on a charged surface of the image holding member;

a developing unit that contains an electrostatic charge image developer including toner that contains toner particles having a shape factor SF1 of 125 to 140 and hydrophobic inorganic oxide particles having a number average particle diameter of 30 nm to 80 nm and satisfies the following Formula (1), and develops the electrostatic charge image which is formed on the surface of the image holding member to form a toner image, by the electrostatic charge image developer;

a transfer unit that transfers the toner image which is formed on the surface of the image holding member to a surface of a recording medium; and a cleaning unit that has a cleaning blade which contacts with the surface of the image holding member at contact pressure of 9.8 mN/mm to 21.6 mN/mm and at a contact angle of 15° to 35°, and removes toner remaining on the surface of the image holding member after transferring the toner image by the cleaning blade:

$$Q \geq 160-12R \quad (1)$$

wherein Q represents the shape factor SF1 of the toner particles and R represents content (% by weight) of the hydrophobic inorganic oxide particles in the toner.

2. The image forming apparatus according to claim 1, wherein the content of the hydrophobic inorganic oxide particles in the toner is from 0.5% by weight to 5% by weight.

3. The image forming apparatus according to claim 1, wherein the content of the hydrophobic inorganic oxide particles in the toner is from 1% by weight to 4% by weight.

4. The image forming apparatus according to claim 1, wherein the content of the hydrophobic inorganic oxide particles in the toner is from 1.2% by weight to 3.5% by weight.

5. The image forming apparatus according to claim 1, wherein the contact pressure of the cleaning blade is from 10.8 mN/mm to 19.6 mN/mm.

6. The image forming apparatus according to claim 1, wherein the contact pressure of the cleaning blade is from 11.8 mN/mm to 19.6 mN/mm.

7. The image forming apparatus according to claim 1, wherein the cleaning blade contacts with the surface of the image holding member at contact pressure between 9.8 mN/mm and 21.6 mN/mm that is sufficient to remove the toner including toner particles having a shape factor SF1 of 125 to 140 and the hydrophobic inorganic oxide particles remaining on the surface of the image holding member after transferring the toner image by the cleaning blade.

8. A process cartridge comprising:

an image holding member;

a developing unit that contains an electrostatic charge image developer including toner that contains toner particles having a shape factor SF1 of 125 to 140 and hydrophobic inorganic oxide particles having a number average particle diameter of 30 nm to 80 nm and satisfies the following Formula (1), and develops the electrostatic charge image which is formed on the surface of the image holding member to form a toner image, by the electrostatic charge image developer; and a cleaning unit that has a cleaning blade which contacts with the surface of the image holding member at contact pressure of 9.8 mN/mm to 21.6 mN/mm and at a contact angle of 15° to 35°, and removes toner remaining on the surface of the image holding member after transferring the toner image by the cleaning blade, wherein the process cartridge is detachable from an image forming apparatus:

$$Q \geq 160-12R \quad (1)$$

wherein Q represents the shape factor SF1 of the toner particles and R represents content (% by weight) of the hydrophobic inorganic oxide particles in the toner.

* * * * *